United States Patent [19]

Lajeuness

[11] 4,112,972

[45] Sep. 12, 1978

[54] WASTE WATER RECLAMATION APPARATUS

[76] Inventor: John B. Lajeuness, 3640 Virginia St., La Crescenta, Calif. 91214

[21] Appl. No.: 801,036

[22] Filed: May 27, 1977

[51] Int. Cl.[2] ..... E03B 3/00

[52] U.S. Cl. ..... 137/597; 137/236 R; 137/356; 137/875

[58] Field of Search ..... 137/236, 356, 357, 597, 137/875

[56] References Cited

U.S. PATENT DOCUMENTS 4,039,005 8/1977 Clifford ..... 137/875 X

*Primary Examiner*—Gerald A. Michalsky
*Attorney, Agent, or Firm*—Roger A. Marrs

[57] ABSTRACT

An apparatus is disclosed herein for interconnecting a plurality of waste water sources in a building which includes a gravity flow conduit arrangement for conducting waste water from the sources to a storage device via a diverter or check valve. A distribution arrangement is operably coupled to the storage device for selectively withdrawing the collected waste water and for dispensing the waste water to predetermined outlets such as earth irrigation devices or the like. The conduit arrangement includes the diverter valve for directing the waste water flow into the storage tank while prohibiting flow-back of contaminated toilet water.

6 Claims, 4 Drawing Figures

Fig. 1
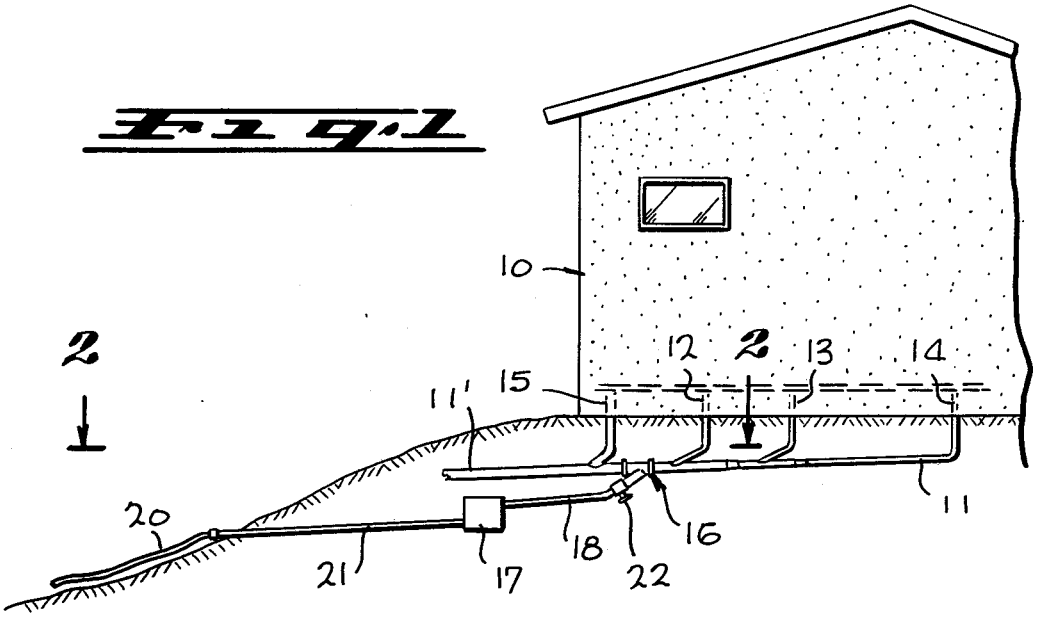
Fig. 2
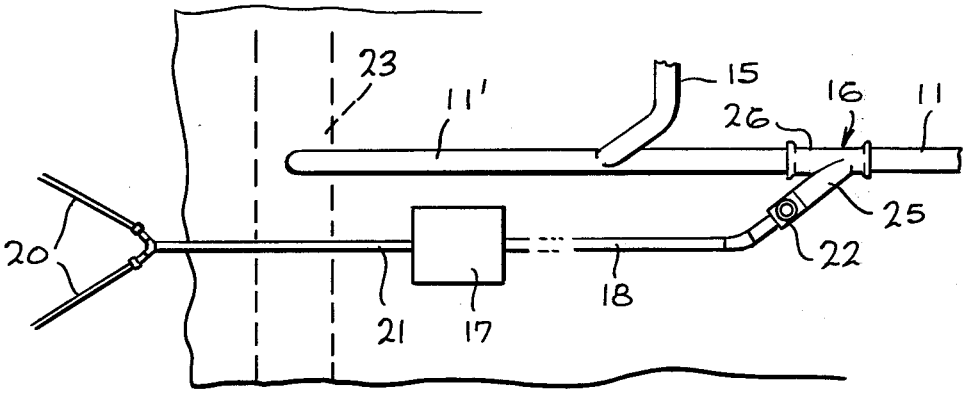
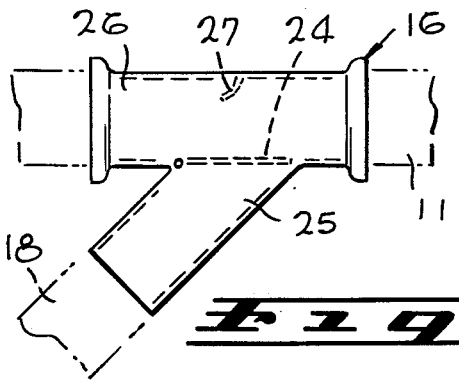
Fig. 3
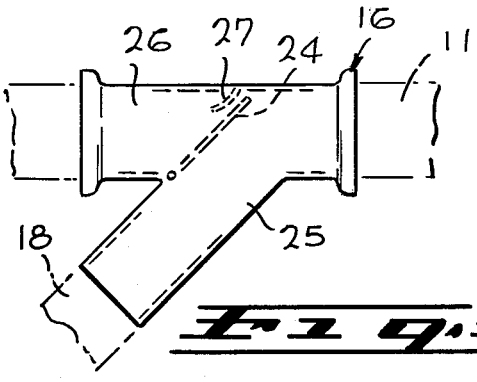
Fig. 4

WASTE WATER RECLAMATION APPARATUS

BACKGROUND OF THE INVENTION

1. Field of the Invention

This invention relates to the field of water reclamation and more particularly to a novel waste water reclamation system incorporating a collection and storage apparatus and a distribution arrangement attached to the apparatus for distributing waste water to predetermined outlets.

2. Brief Description of the Prior Art

In the past, it has been the conventional practice to discard waste water by conducting the waste water directly into a sewer or holding tank arrangement. The conduits interconnecting the waste water sources and the sewer are direct and no attempt has been made to salvage, reclaim or otherwise utilize the waste water for any useful purpose. Fresh water is used for lawn and plant irrigation as well as for flushing of the toilet. For example, normal plant irrigation generally employs a flexible hose connected to a fresh water outlet via a shut-off valve so that the fresh water may be supplied to a particular lawn area via a sprinkler system or the hose.

However, modern day conservation practices have attempted to reclaim the waste water which is sometimes referred to as "gray" water for certain limited purposes. In this connection, means are required for distributing the waste water for useful purposes. Therefore, a long standing need has existed to provide a means for selectively collecting waste water and for distributing the waste water to selected outlets for useful purposes.

In this connection, it is necessary to separate "gray" water which is susceptible for reclamation from unsanitary "black" water such as toilet water. Black water must be conducted directly to the sewer and must be vented to atmospheric pressure to insure against downstream backflow.

SUMMARY OF THE INVENTION

Accordingly, the above problems and difficulties are obviated by the present invention which provides a novel waste water reclamation apparatus and system for interconnecting waste water sources to a plurality of outlets for the useful employment of the waste water. The inventive concept of the present invention provides a conduit arrangement operably coupled to selected sources of waste water whereby the water is collected into a storage container and held in the container pending demand distribution of the waste water into selected outlets such as for lawn and plant irrigation purposes. Means are provided for gravity flow of the waste water through the system and a diverter valve is included for separating "gray" water from the conventional black water sewer system. This "gray" water diverter is unique and separates "gray" water from the sewer with an absolute minimum of parts. This one-piece device also maintains proper sewer functioning in its open position by allowing atmospheric pressure to reach downstream backflow from reaching the diversion (i.e., sewage going to the garden). In the open position, it is 100% efficient with normal flow; with peak flow it has an efficiency of about 90%. In the closed position, it maintains the original drain and sewer function.

Therefore, it is among the primary objects of the present invention to provide a novel waste water reclamation system and apparatus which collects waste water from selected sources and distributes the waste water to selected outlets.

Another object of the present invention is to provide a novel waste water reclamation system and apparatus which collects waste water from selected sources and stores the waste water in a suitable container for distribution to selected outlets at predetermined times.

Still a further object of the present invention is to provide a novel waste water reclamation system incorporating conduits interconnecting selected waste water sources to a storage unit for collection and holding purposes until it is desired to distribute the water to selected outlets such as for achieving useful purposes of lawn and plant irrigation.

Still a further object of the present invention is to provide a novel waste water reclamation system for recirculating the waste water for useful purposes so that fresh water is conserved.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevational view of a typical building incorporating the novel waste water reclamation system of the present invention;

FIG. 2 is an enlarged plan view of the system utilized in FIG. 1 as taken in the direction of arrows 2—2 thereof; and FIGS. 3 and 4 are enlarged sectional views of the diverter valve employed in the inventive system.

DESCRIPTION OF THE PREFERRED EMBODIMENT

Referring to FIG. 1, a building 10 is illustrated having a conventional supply of waste water provided to a common disposal line 11. The disposal line 11 is connected to the sources of waste water such as sinks, washing machines, shower and tub arragements and the like via connecting conduits 12, 13 and 14. A connecting conduit 15 is illustrated which couples the discharge of the toilet to the conduit 11 for disposal to a connecting sewer (now shown). Therefore, it can be seen that connecting conduits 12, 13 and 14 collect and conduct "gray" water to the conduit 11 while the connecting conduit 15 collects "black" water for discharge directly to the sewer. Interposed between the gray and black water connecting conduits, there is provided a diverter device indicated in general by numeral 16.

The diverter device 16 is arranged to conduct the gray water from line or conduit 11 to a storage container 17 via a pipe or conduit 18. The storage container 17 is connected to an irrigation system or discharge arrangement 20 via an outlet conduit 21. A feature of the invention resides in the provision of a gate valve 22 which is immediately ahead of the conduit 18 whereby the user may shut off the system so that the gray water will discharge directly to the sewer in combination with the discharge of black water. Also, it is to be noted that the system is a gravity flow type and does not require any form of pumping or other auxillary force.

Referring now to FIG. 2, it can be seen that one end of the conduit 11 identified by numeral 11' is directly coupled to a sewer 23 while the diverter valve 16 branches the gray water directly to the storage container 17. A feature of the diverter device includes a hinged arrangement identified by the numeral 24 which permits the gray water to be conducted through a downwardly depending branch 25 and through the gate valve 22 to the storage tank 17. The other branch, indicated by numeral 26 is directly connected to the black water disposal system and the flap or gate 24 prevents black water from backing up into the diverter valve and from getting into the storage tank 17 through the downwardly depending branch 26.

The diverter device is more clearly shown in FIGS. 3 and 4 which takes the shape of a Y and wherein the flap or gate 24 is pivotally attached to the central separation between a pair of openings. In FIG. 3, the flap 24 is in its closed position so that conduction of gray water is directed into the sewer. In this position, the flap of the diverter valve closes the downwardly depending section 25 and no gray can pass therethrough. In FIG. 4, the flap 24 is open so that all gray water will be conducted through the branch or section 25.

In the open position, as shown in FIG. 4, the valve means does not completely block the horizontal portion of the diverter. This allows upstream vents to provide atmospheric pressure to the downstream drains. In order to prevent complete blocking, a back-flow device or element 27 is employed. Therefore, any suction in the system is completely eliminated.

Therefore, it can be seen that the novel waste water reclamation system of the present invention provides an apparatus which makes ready use of waste water which otherwise would be discarded directly into a sewer line. The waste water is under control at all times by respective diverter means 16 and gate valve 22. The apparatus may be installed in old construction as well as in new construction and installation requires only the use of clamps for securing the horizontal portions or ends of the diverter means directly into the disposal line 11. The conduit 18 and gate valve 22 may be readily coupled to the downwardly depending branch or section 25 of the diverter means by a suitable clamp or other suitable coupling means.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A waste water reclamation system and apparatus comprising the combination of:

a plurality of household waste water sources;

a common conduit;

conduit means coupling with said waste water sources to said common conduit whereby gravity flow urges the waste water into and through said common conduit;

storage means for holding said waste water;

diverter means including a conduit interconnecting said common conduit with said storage means; and a multiplicity of outlets coupled to said storage means for selectively distributing said waste water for predetermined purposes.

2. The invention as defined in claim 1 wherein:

said storage means is a tank buried below ground level.

3. The invention as defined in claim 2 wherein:

said diverter means is critically located between selected ones of said conduit means so as to block waste water from some waste water sources and accept waste water from other waste water sources.

4. The invention as defined in claim 3 wherein:

said diverter means further includes a section coupled into said common conduit and having a branch conduit downwardly depending therefrom; and a valve means incorporated therein for blocking flow of waste water from said some of said waste water sources so that only waste water from said other waste water sources are allowed to be conducted from said common conduit.

5. The invention as defined in claim 1 wherein said diverter means comprises:

a Y-shaped conduit connected at an opposite pair of ends to said common conduit and having the remaining end coupled to said storage tank;

valve means operably carried by said diverter means to selectively direct waste water flow into said storage tank.

6. The invention as defined in claim 5 wherein:

said selected waste water constitutes "gray" water and said non-selected waste water constitutes "black" waste water.

* * * * *